US009518419B2

(12) United States Patent
Johnson et al.

(10) Patent No.: US 9,518,419 B2
(45) Date of Patent: Dec. 13, 2016

(54) DOOR MOUNT

(71) Applicant: Target Brands, Inc., Minneapolis, MN (US)

(72) Inventors: Blake M. Johnson, St. Paul, MN (US); Chadley W. Ewald, West Lakeland Township, MN (US)

(73) Assignee: Target Brands, Inc., Minneapolis, MN (US)

( * ) Notice: Subject to any disclaimer, the term of this patent is extended or adjusted under 35 U.S.C. 154(b) by 152 days.

(21) Appl. No.: 14/199,341

(22) Filed: Mar. 6, 2014

(65) Prior Publication Data

US 2015/0252610 A1 Sep. 10, 2015

(51) Int. Cl.

| | |
|---|---|
| ***E06B 3/36*** | (2006.01) |
| ***E05D 5/04*** | (2006.01) |
| ***E05F 1/06*** | (2006.01) |

(52) U.S. Cl.

CPC . *E06B 3/36* (2013.01); *E05D 5/04* (2013.01); *E05F 1/063* (2013.01)

(58) Field of Classification Search

CPC ..... E05F 1/043; E05F 1/06; E05F 1/061; E05F 1/063; E05F 1/065; E05F 1/066; E05F 1/068; E05F 1/00; E05F 1/02; E05F 1/04; E05F 1/046; E05D 7/04; E05D 7/0423; E05D 7/0407; E05D 7/00; E05D 7/0009; E05D 7/009; E05D 5/10; E05D 5/12; E05D 5/0215; E05D 5/0223; E05D 5/023; E05D 5/0238; E05D 5/0276; E05D 2005/102; E05D 2005/106; E05D 3/00; E05D 3/02; E05D 3/06; E05D 3/08; E05D 3/10; E05D 3/12; E05D 3/122; Y10T 16/539; Y10T 16/5398; E06B 3/36

See application file for complete search history.

(56) References Cited

U.S. PATENT DOCUMENTS

| | | | | | |
|---|---|---|---|---|---|
| 2,968,830 | A | * | 1/1961 | Huntley | 16/248 |
| 3,063,089 | A | | 11/1962 | Greenman | |
| 3,085,665 | A | * | 4/1963 | Benham | E05D 5/0215 248/218.4 |
| 3,107,758 | A | * | 10/1963 | Benham | E05F 1/1223 16/284 |
| 3,113,649 | A | | 12/1963 | Wargo | |
| 3,115,665 | A | | 12/1963 | Cecala | |
| 3,171,157 | A | * | 3/1965 | Raymond | E05D 7/009 16/390 |
| 3,210,799 | A | * | 10/1965 | Schooler | 16/318 |
| 3,325,942 | A | | 6/1967 | Bejarano | |

(Continued)

OTHER PUBLICATIONS

Office Action from Canadian Patent Application No. 2,845,221, mailed Aug. 5, 2014 (2 pages).

*Primary Examiner* — Jessica Laux

(74) *Attorney, Agent, or Firm* — Leanne Taveggia Farrell; Westman, Champlin, & Koehler, P.A.

(57) ABSTRACT

A door mount includes a jamb mounted to an end of a wall, a bracket, an upper hinge and a lower hinge. The bracket includes an upper flange that extends in a direction away from the jamb, an elongated member mounted to the jamb and a lower flange that extends in the direction away from the jamb and is spaced apart from the upper flange by the elongated member. The upper hinge couples the upper flange of the bracket to the door. The lower hinge couples the lower flange of the bracket to the door.

19 Claims, 7 Drawing Sheets

(56) References Cited

U.S. PATENT DOCUMENTS

| | | | | | |
|---|---|---|---|---|---|
| 3,378,881 | A * | 4/1968 | Hentzi et al. | 16/312 |
| 3,405,960 | A * | 10/1968 | Wargo | 292/145 |
| 3,604,154 | A | 9/1971 | Curran | |
| 3,651,538 | A | 3/1972 | Jentsch | |
| 3,662,493 | A | 5/1972 | Foltz | |
| 3,827,183 | A | 8/1974 | Zimmerman et al. | |
| 3,932,913 | A | 1/1976 | Johnson | |
| 4,106,158 | A | 8/1978 | Kellems et al. | |
| 4,815,162 | A | 3/1989 | McAteer | |
| 5,054,163 | A | 10/1991 | Sterling et al. | |
| 5,363,611 | A | 11/1994 | Richardson et al. | |
| 5,544,454 | A | 8/1996 | Richardson et al. | |
| 5,711,121 | A * | 1/1998 | Garver | 52/239 |
| 6,609,335 | B1 | 8/2003 | Hyakkoku | |
| 2005/0193522 | A1* | 9/2005 | Jackson | 16/316 |
| 2006/0090297 | A1* | 5/2006 | Chue | 16/312 |
| 2006/0231218 | A1 | 10/2006 | Liang | |
| 2013/0067689 | A1* | 3/2013 | Mitchell | E05D 5/04 16/382 |

* cited by examiner 102
131
116
106
130
124
128
132
118
104
300

102
106
6
200
104
100
300
108

DOOR MOUNT

BACKGROUND

A fitting room in a retail store may include a swinging door that is hinged to a door jamb. The door jamb is fixed to an end of a wall panel. The swinging door includes hinges that are mounted to the door jamb so that the swinging door can rotate relative to the wall panel.

The discussion above is merely provided for general background information and is not intended to be used as an aid in determining the scope of the claimed subject matter.

SUMMARY

A door mount includes a jamb mounted to an end of a wall, a bracket, an upper hinge and a lower hinge. The bracket includes an upper flange that extends in a direction away from the jamb, an elongated member mounted to the jamb and a lower flange that extends in the direction away from the jamb and is spaced apart from the upper flange by the elongated member. The upper hinge couples the upper flange of the bracket to the door. The lower hinge couples the lower flange of the bracket to the door.

A door mount includes an elongated bar having a substantially vertical member attached to a door jamb, a top end and a bottom end. The top end includes a top projecting member that extends substantially normal to the substantially vertical member and a bottom projecting member that extends substantially normal to the substantially vertical member. A top hinge couples a door to the top projecting member. A bottom hinge couples the door to the bottom projecting member. The door is oriented at an acute angle relative to the door jamb when at rest.

A method of mounting a door to a wall includes mounting a hinge mount bar to an end of a wall. The hinge mount bar includes an upper flange that extends in a direction away from the end of the wall, an elongated member and a lower flange that extends in the direction away from the end of the wall and is spaced apart from the upper flange by the elongated member. The hinge mount bar provides repeated placement of the upper flange relative to the lower flange. The method further includes fastening an upper hinge to the upper flange of the hinge mount bar and fastening a lower hinge to the lower flange of the hinge mount bar.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A swinging door, which is a type of door installed in fitting rooms and restrooms, is coupled to a wall by at least two hinges. Each hinge is mounted to its own bracket and each bracket is attached to the wall. The placement of these brackets relative to each other and relative to the wall is important to the operation of the swinging door. If, for example, the brackets are not mounted plumb to a door jamb, portions of the hinges can interfere with the door jamb. Such interference can cause cracking in the door, bending in the door straps and ultimately complete door failure. In another example, if the brackets are mounted too far away from each other, the upper hinge could come loose and the door could fall.

Embodiments of the door mount described below provide for repeated placement of a door on a wall using a hinge mount bar or elongated bar. More particular, the door mount provides repeated plumb placement and relative placement of a mechanism for attaching the door to a wall. The hinge mount bar includes an upper projecting member, a lower projecting member and an elongated member. The upper projecting member and the lower projecting member are oriented substantially normal to the elongated member. The upper projecting member is spaced apart from the lower projecting member by the elongated member. The hinge mount bar is a single piece or a single assembly and therefore a door can be repeatedly coupled to the hinge mount bar without error.

Figures 1, 6:
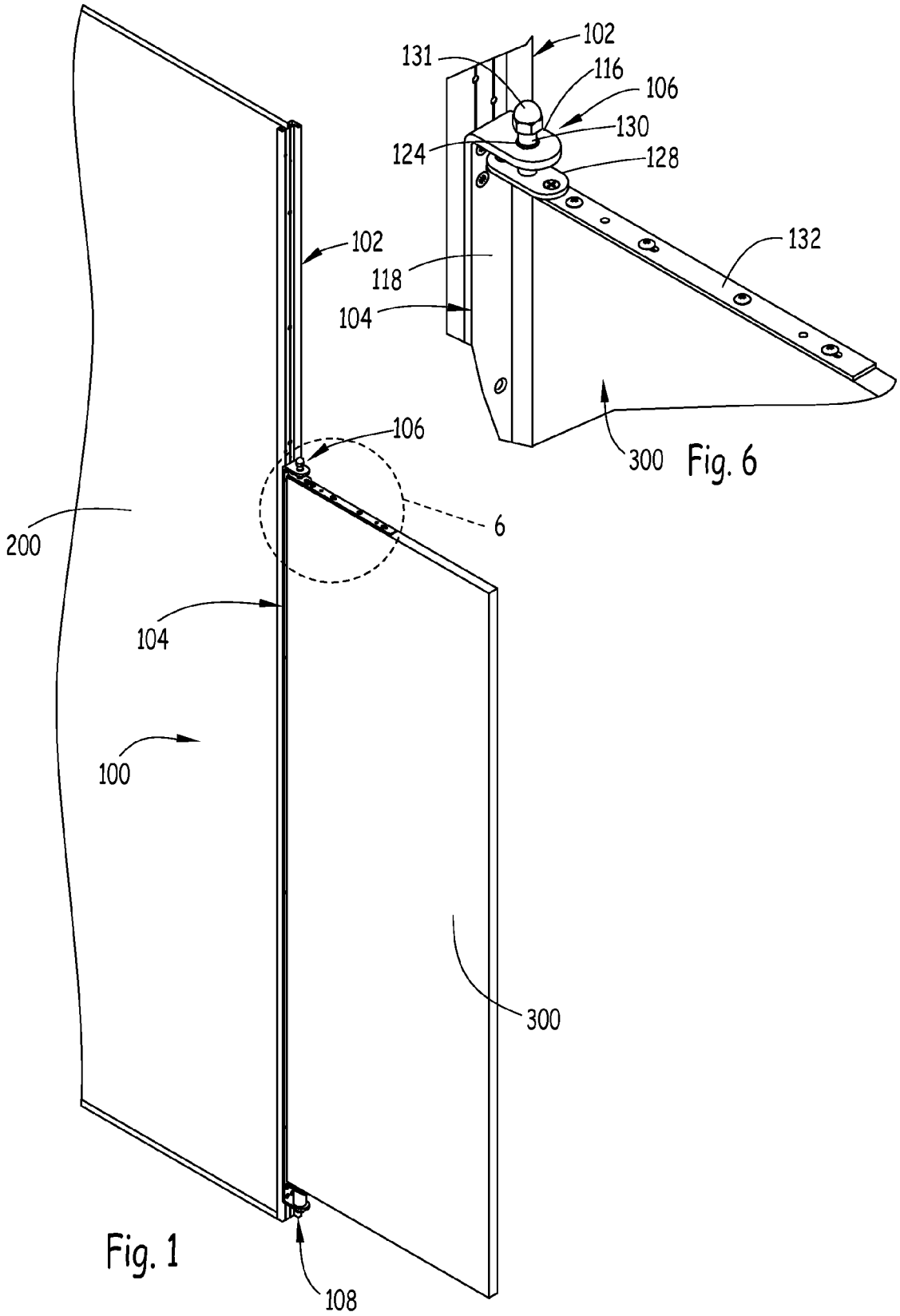
FIG. 1 is a top perspective view of a door mount in accordance with one embodiment.
FIG. 6 is an enlarged perspective view of a portion of the door mount as indicated in FIG. 1.

FIG. 1 is a top perspective view of a door mount 100 in accordance with one embodiment. Door mount 100 couples a door 300 to a wall 200. Door mount 100 includes a jamb 102 mounted to an end of wall 200, a bracket (i.e., elongated bar or hinge mount bar) 104, an upper hinge (i.e., top hinge) 106 and a lower hinge (i.e., bottom hinge) 108. Each of the components of door mount 100 will be discussed in detail below.

Figure 2:
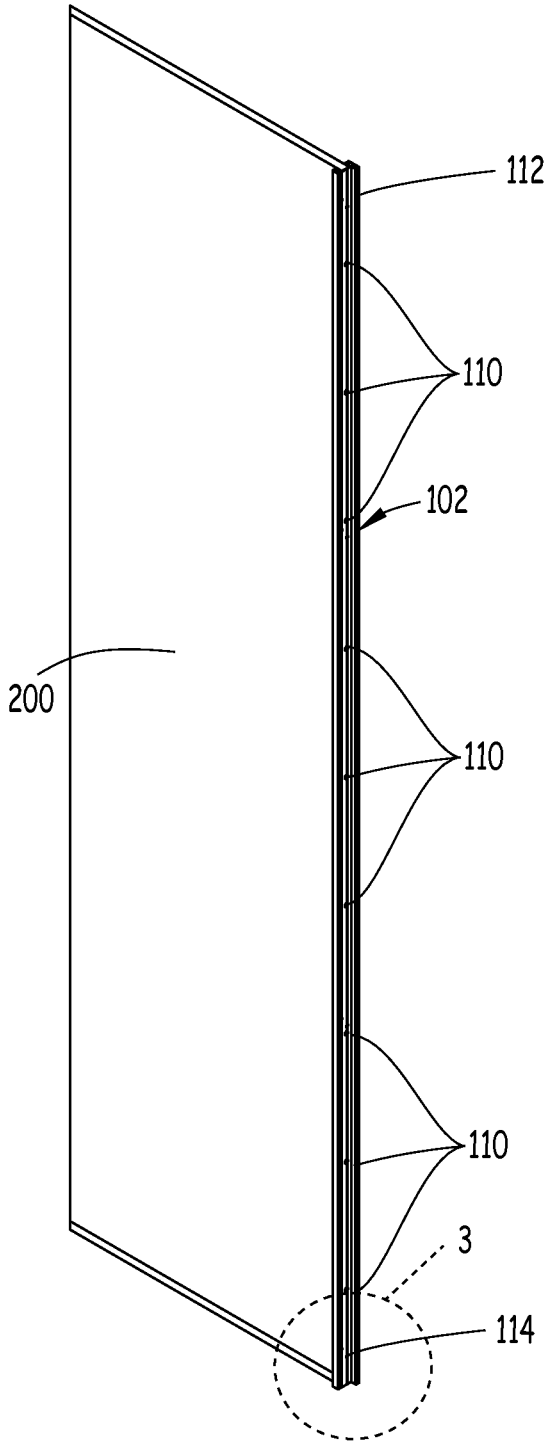
FIG. 2 is a top perspective view of a jamb mounted to an end of a wall in accordance with the embodiment illustrated in FIG. 1.
Figure 3:
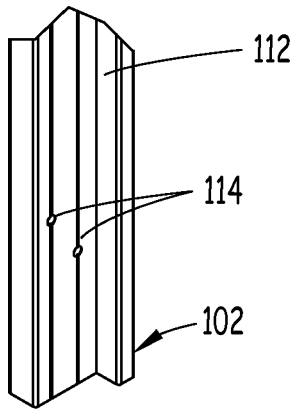
FIG. 3 is an enlarged perspective view of a portion of the jamb as indicated in FIG. 2.

FIG. 2 is a top perspective view of door jamb 102 mounted to the end of wall 200 in accordance with the embodiment illustrated in FIG. 1. FIG. 3 is an enlarged perspective view of a portion of jamb 102 as indicated in FIG. 2. Door jamb 102 is a vertical frame member that is fastened to the end wall 200 by fasteners 110 and is the component onto which a door is secured. Door jamb 102 supports the weight of the door via hinges and includes a stop 112 so that the door cannot swing farther than stop 112. As illustrated in FIG. 3, door jamb 102 includes drilling dimples 114. Drilling dimples 114 pinpoint the exact location to which a bottom section of bracket 104 should be mounted to door jamb 102.

Figure 11:
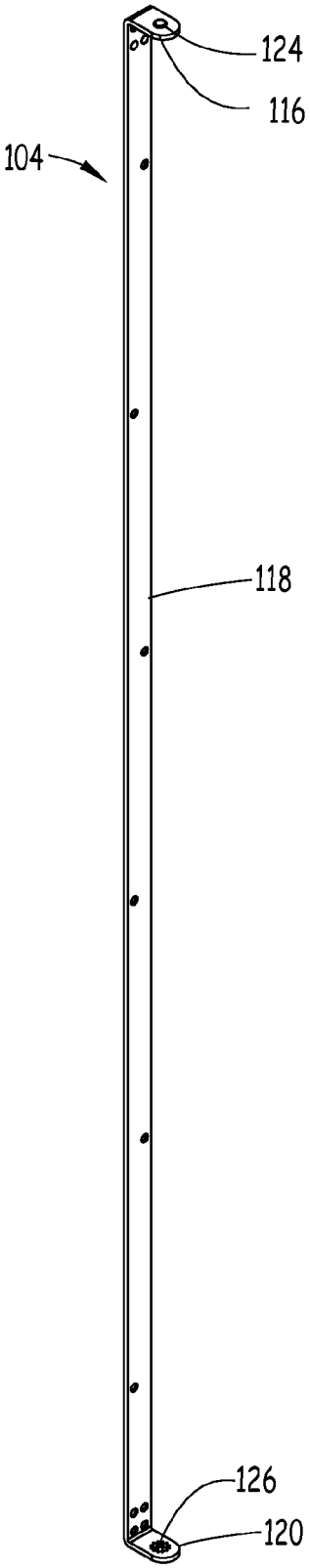
FIG. 11 is a perspective view of the hinge mount bar illustrated in FIG. 1.
Figure 12:
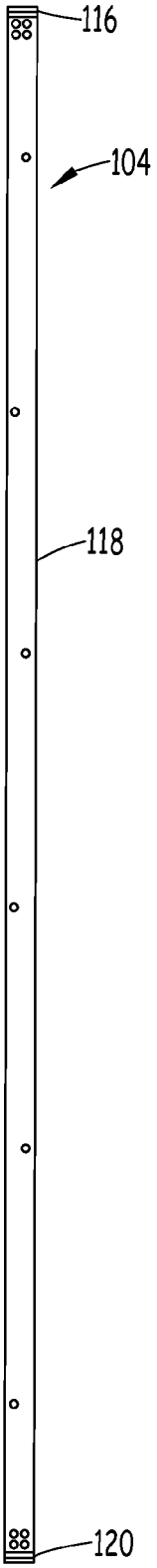
FIG. 12 is a front view of the hinge mount bar illustrated in FIG. 1.
Figure 13:
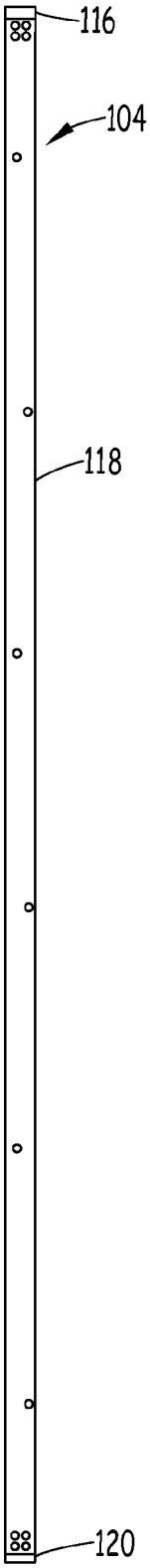
FIG. 13 is a back view of the hinge mount bar illustrated in FIG. 1.
Figure 14:
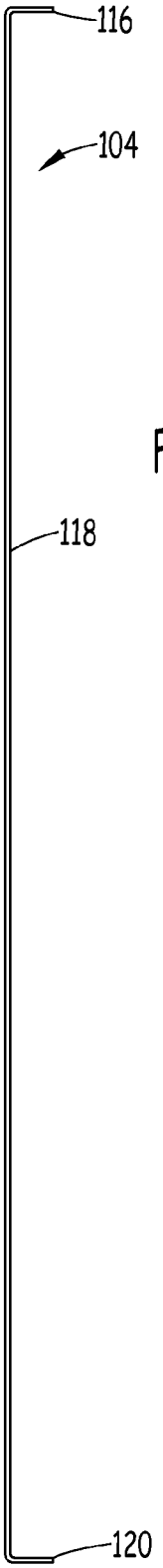
FIG. 14 is a side view of the hinge mount bar illustrated in FIG. 1.
Figure 15:
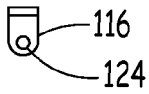
FIG. 15 is a top view of the hinge mount bar illustrated in FIG. 1.
Figure 16:
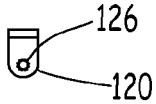
FIG. 16 is a bottom view of the hinge mount bar illustrated in FIG. 1.

FIG. 11 is a perspective view of bracket (i.e., elongated bar or hinge mount bar) 104 and FIGS. 12-16 are orthogonal views of bracket 104 including a front view, a back view, a side view (the opposing side being a mirror image), a top view and a bottom view. Bracket 104 includes an upper flange (i.e., top projecting member) 116, an elongated member (i.e., substantially vertical member) 118 and a lower flange (i.e., bottom projecting member) 120.

In one embodiment, bracket is made from a single, continuous piece of material, such as steel, where upper and lower flanges 116 and 120 are formed by bending the material out-of-plane from the material of elongated member 118. In other embodiments, upper flange 116, lower flange 120 and elongated member 118 are made of individual pieces of material that are connected together by, for example, welding or fasteners. In still another embodiment (but not shown), elongated member 118 can be made of multiple connected pieces that can slide or move relative to each other. In such an embodiment, the length of elongated member 118 could be adjustable to accommodate different sizes of doors that have different heights. The adjustability of the length of elongated member 118 would provide for adjustability in the separation distance between upper flange 116 and lower flange 120.

Figure 4:
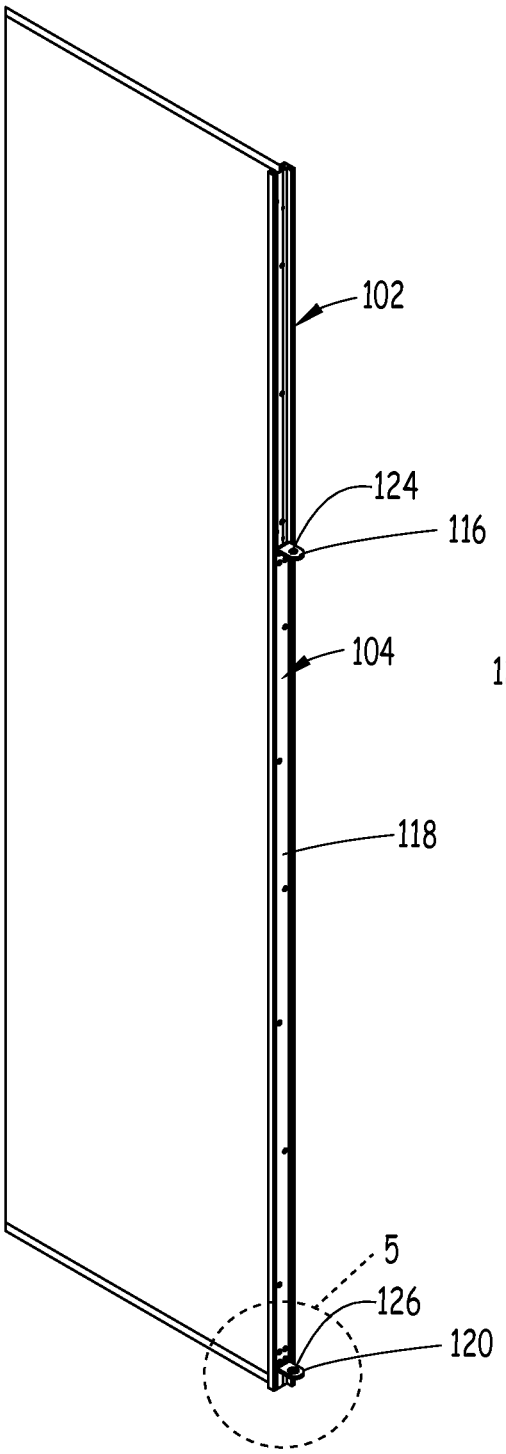
FIG. 4 is a top perspective view of a hinge mount bar attached to the door jamb illustrated in FIG. 2 in accordance with the embodiment illustrated in FIG. 1.

The top end of bracket 104 includes upper flange 116, which is oriented substantially normal to elongated member 118 so as to be substantially horizontal relative to the substantially vertical orientation of elongated member 118. Upper flange 116 is spaced apart from lower flange 120 by a length of elongated member 118. When bracket 104 is mounted to jamb 102 (as illustrated in FIG. 4), upper flange 116 extends in a direction away from jamb 102. The bottom end of bracket 104 includes lower flange 120, which is oriented substantially normal to elongated member 118 so as to be substantially horizontal relative to the substantially vertical orientation of elongated member 118. Lower flange 120 is spaced apart from upper flange 116 by the length of elongated member 118. When bracket 104 is mounted to jamb 102 (as illustrated in FIG. 4), lower flange 120 extends in a direction away from jamb 102.

Figure 5:
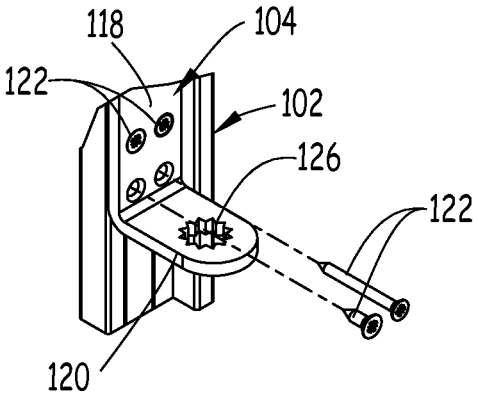
FIG. 5 is an enlarged perspective view of a portion of the hinge mount bar attached to the door jamb as indicated in FIG. 4.

FIG. 4 is a top perspective view of bracket 104 attached to door jamb 102 in accordance with the embodiment illustrated in FIG. 1. FIG. 5 is an enlarged perspective view of a portion of bracket 104 attached to door jamb 102 as indicated in FIG. 4. Elongated member 118 is the component of bracket 104 that is directly coupled to jamb 102. In particular and as illustrated in FIG. 5, holes in a lower section (proximal to lower flange 120) of elongated member 118 are aligned with drilling dimples 114 in jamb 102 and elongated member 118 is fastened to jamb 102 using fasteners 122. Exemplary fasteners 122 include pins and screws. In some embodiments fasteners 122 includes pins and screws of varying lengths. As illustrated in FIG. 5, short screws are used on the outside row of holes and long screws are used on the inside row of holes. In other embodiments, fasteners 122 have substantially the same length. Similarly, holes in an upper section (proximal to upper flange 116) of elongated member 118 are used to fasten elongated member 118 to jamb 102 using fasteners. Additional fasteners (as illustrated in FIG. 4) can be used across a length of elongated member 118 to further secure bracket 104 to jamb 102 for added strength.

Upper flange 116 includes a through hole 124 and lower flange 120 includes a through hole 126. The central axis of through hole 124 is in alignment with the central axis of through hole 126. Because through hole 124 and through hole 126 extend through upper flange 116 and lower flange 120, respectively, the central axes of through holes 124 and 126 are substantially vertical and substantially parallel to elongated member 118. In one embodiment, while through hole 124 is circular in shape and accordingly has a single diameter dimension, through hole 126 has a non-circular shape and accordingly has two diameter dimensions. For example and as illustrated in FIG. 5, through hole 126 comprises a star shape. A first diameter includes the dimension of the through hole at the inner points of the star shape and a second diameter includes the dimension of the through hole at the outer points of the star shape.

FIG. 6 is an enlarged perspective view of a portion of door mount 100 as indicated in FIG. 1. In particular, FIG. 6 is an enlarged view of upper hinge 106, which couples door 300 to upper flange 116 of bracket 104. Upper hinge 106 includes an upper hinge plate 128 coupled to an upper hinge pin 130. Upper hinge pin 130 extends from upper hinge plate 128 into through hole 124 in upper flange 116 and terminates at a free end. As illustrated in FIG. 6, the free end is fastened with a nut 131.

An upper door strap 132 is mounted to a top end of door 300 and fixed to upper hinge plate 128 of upper hinge 106. In this configuration, not only is upper hinge pin 130 free to rotate within through hole 124 and thereby allow door 300 to rotate about the central axis of through hole 124, but upper hinge pin 130 can also move axially (i.e., up and down) along the central axis of through hole 124 thereby moving door 300 up and down as well. The axial movement upper hinge pin 130 is limited by upper hinge plate 128 and nut 131, which is installed on the free end of upper hinge pin 130. When installed, the axial movement of the door is also limited by upper and lower flanges 116 and 120 of bracket 104.

Figure 7:
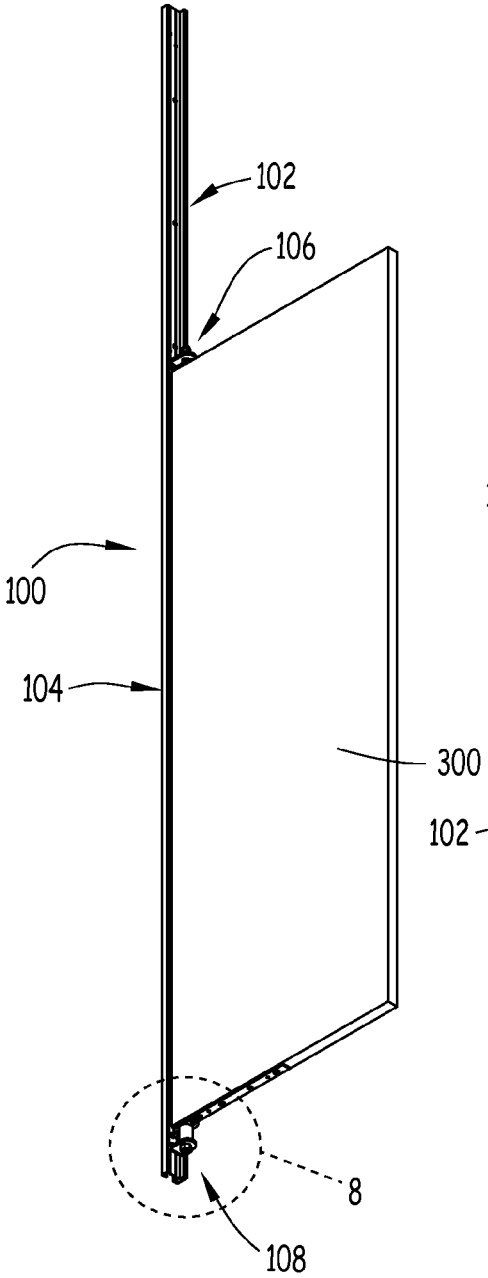
FIG. 7 is a bottom perspective view of the door mount as illustrated in FIG. 1.
Figure 8:
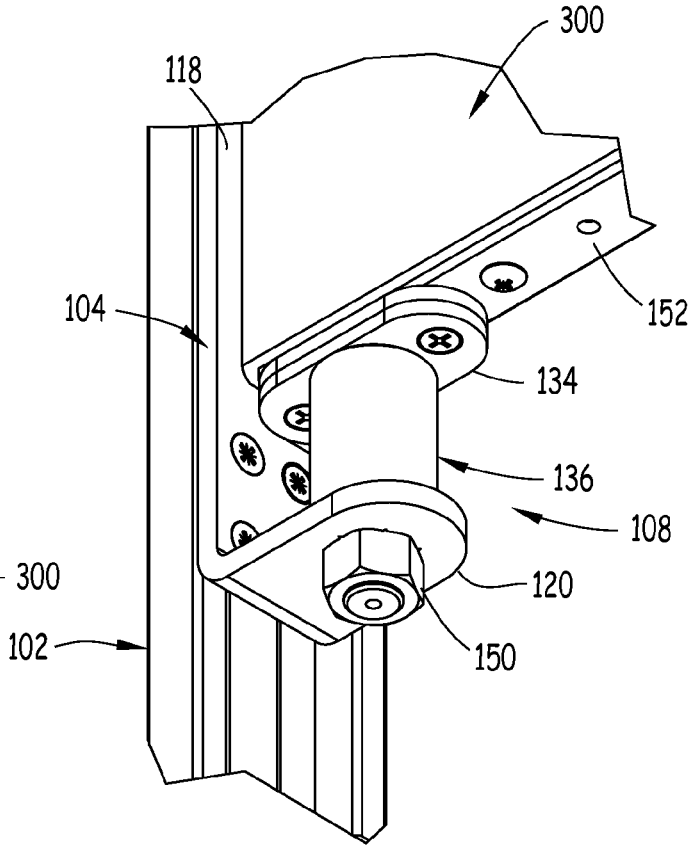
FIG. 8 is an enlarged perspective view of a portion of the door mount as indicated in FIG. 7.

FIG. 7 is a bottom perspective view of door mount 100. FIG. 8 is an enlarged perspective view of a portion of door mount 100 as indicated in FIG. 7. In particular, FIG. 8 is an enlarged perspective view of lower hinge 108, which couples door 300 to lower flange 120 of bracket 104. Lower hinge 108 includes a lower hinge plate 134 coupled to a gravity pivot assembly 136. Lower hinge 108 provides a mechanism that in combination with the functionality of upper hinge 106 is capable of orienting a door relative to the wall at an acute angle when at rest. In other words, the door is oriented relative to the wall at an acute angle when it is unlocked and free from user manipulation.

Figure 9:
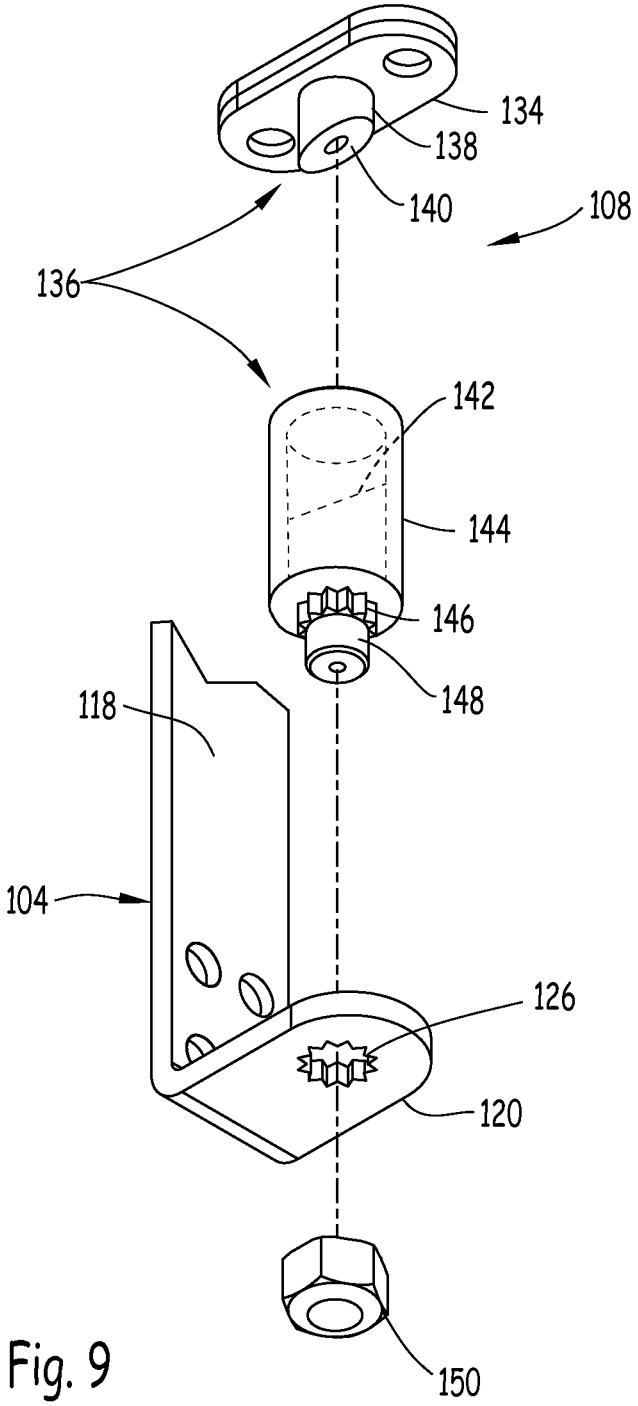
FIG. 9 is an exploded perspective view of the lower hinge of the door mount illustrated in FIG. 7 in accordance with the embodiment illustrated in FIG. 1.

FIG. 9 is an exploded perspective view of lower hinge 108 of door mount 100 and the lower section of bracket 104 of door mount 100. As illustrated, gravity pivot assembly 136 includes a lower hinge pin 138 fixed to lower hinge plate 134 and extending from lower hinge plate 134 to a beveled end 140. Beveled end 140 engages with a corresponding beveled surface 142 (shown in phantom) located in cam 144. Cam 144 further includes a drive 146 that protrudes from the main body of cam 144. In one embodiment, drive 146 is shaped to correspond with the shape of the through hole 126 in the lower flange 120.

More specifically, drive 146 is star-shaped and corresponds with the star shape of through hole 126. Star-shaped drive 146 engages with star-shaped through hole 126 in lower flange 120 so that a door can be oriented open relative to the wall at the acute angle when at rest. For example, the door can be oriented open relative to the wall at a 30 degree angle when at rest. In other words, set points of the star on drive 146 engage with set points of the star in through hole 126 to ensure the 30 degree angle. However, different set points of the star on drive 146 can be engaged with set points of the star in through hole 126 to change the angle to which the door will be open relative to the wall at rest. A shaft 148 extends from drive 146 and receives a nut 150 to secure gravity pivot assembly 136 to lower flange 120.

With reference back to FIGS. 7 and 8, a lower door strap 152 is mounted to a bottom end of door 300 and is fixed to lower hinge plate 134 of lower hinge 108. In this configuration, when door 300 is rotated, lower hinge pin 138 having beveled end 140 rotates within cam 144. Beveled surface 142 pushes lower hinge pin 138 in an upward and axial direction so that door 300 can rotate into a closed position for locking. Because upper hinge pin 130 is able to move axially in either an upward or downward direction along the central axis of through hole 124, the entire door is moves upwards to close. Upon being unlocked, lower hinge pin 138 automatically rotates back to engage with beveled surface 142 and upper hinge pin 130 moves axially downward along the central axis of through hole 124 so that door 300 is placed back into a position that is oriented at an acute angle relative to the wall.

To mount door 300 to wall 200, hinge mount bar 104 is mounted to an end of wall 200. More particularly, hinge mount bar 104 is mounted to wall 200 by attaching hinge mount bar 104 to jamb 102, which is coupled to the end of wall 200. By mounting hinge mount bar 104 to jamb 102, upper flange 116 is precisely placed on jamb 102 relative to lower flange 120. In addition, upper flange 116 and lower flange 120 are substantially oriented plumb to jamb 102. If either upper flange 116 or lower flange 120 are even slightly skewed, the lower flange 120 or upper flange 116 will be unable to be located on jamb 102 and therefore eliminates error in alignment and placement of upper and lower flanges 116 and 120. Still further, drilling dimples 114 located on jamb 102 provide a location for mounting holes in lower flange 120 to be aligned on jamb 102 and coupled to jamb 102 via fasteners 122.

Upper hinge 106 is fastened to upper flange 116 of hinge mount bar 104. More specifically, upper hinge plate 128 is fastened to upper door strap 132, which is not yet attached to door 300, using fasteners. Upper hinge pin 130 that extends from upper hinge plate 128 is then inserted into through hole 124 in upper flange 116. Nut 131 is installed on the free end of upper hinge pin 130 to keep upper hinge pin 130 within through hole 124. As discussed above, upper hinge pin 130 is capable of rotational movement within through hole 124 as well as axial movement in upward and downward directions.

Lower hinge 108 is fastened to lower flange 120 of hinge mount bar 104. More specifically, lower hinge plate 134 is fastened to lower door strap 152, which is already installed on a bottom end of door 300, using fasteners. Gravity pivot assembly 136, which is coupled to lower hinge plate 134 via lower hinge pin 138, is fastened to lower flange 120 of hinge mount bar 104 by inserting star-shaped drive 146 into star-shaped hole 126 in lower flange 120. Drive 146 is inserted into through hole 126 in such a way as to position door 300 so that it will be oriented at an acute angle relative to wall 200 when at rest.

For example, drive 146 is inserted into through hole 126 so that door 300 is oriented at a 30 degree angle relative to wall 200. As described above, set points of the star on drive 146 engage with set points of the star in through hole 126 to ensure the 30 degree angle. However, different set points of the star on drive 146 can be engaged with set points of the star in through hole 126 to change the angle to which the door will be open relative to the wall at rest. For example, drive 146 can be inserted into through hole 126 to set the door to be open relative to the wall at 20 degrees, 60 degrees and etc. Shaft 148 extends from drive 146. Gravity pivot assembly 136 is secured to lower flange 120 by threading nut 150 onto an end of shaft 148.

Upper door strap 132, upper hinge plate 128 and upper hinge pin 130 are then raised relative to through hole 124 in upper flange 116 so that a top end of door 300 can be positioned underneath upper door strap 132. Upper door strap 132 is installed on top end of door 300 using fasteners.

Figure 10:
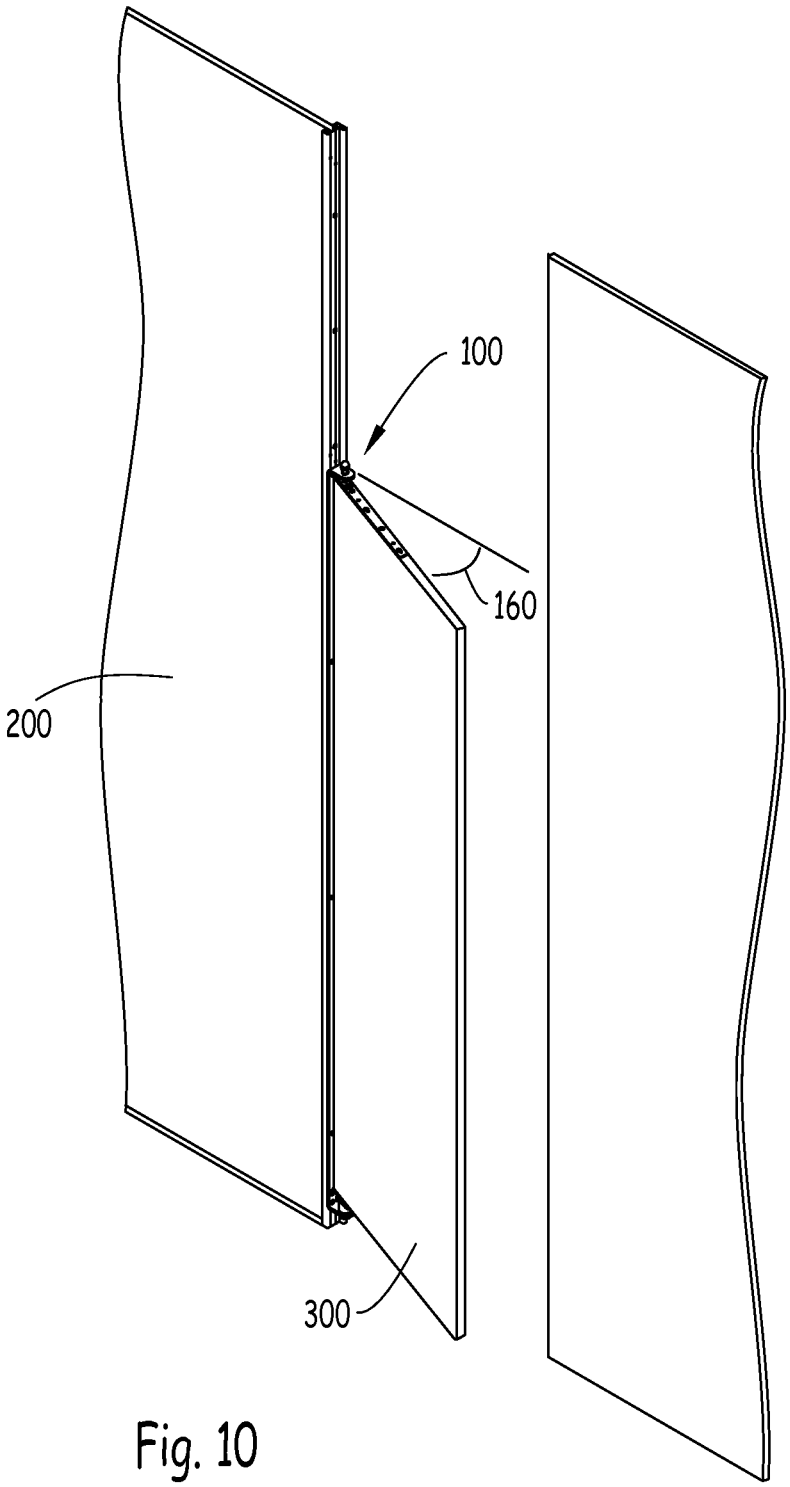
FIG. 10 is a top perspective view of the door mount illustrated in FIG. 1 with the door being oriented at an acute angle relative to the wall when at rest.

FIG. 10 illustrates door mount 100 coupling door 300 to wall 200 at rest. At rest, door 300 is oriented at an acute angle 160, such as 30 degrees, relative to wall 200. Depending on the requirements of the implementation, the view illustrated in FIG. 10 may be illustrating the interior of a fitting room or an exterior of a fitting room. In one embodiment, door 300 may be set to open at rest in a position that protrudes into the fitting room at acute angle 160, while in other embodiments door 300 may be set to open at rest in a position that protrudes out of the fitting room.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A door mount comprising:

a jamb mounted to an end of a wall;

a monolithic bracket having a first free end, an opposing second free end, a planar upper flange, a planar elongated section and a planar lower flange and being mounted to the jamb along the planar elongated section, wherein the planar upper flange is oriented out of plane relative to the elongated section at a first bend, is defined between the first free end of the monolithic bracket and the first bend and extends along a horizontal plane substantially perpendicular to the elongated section and in a direction away from the jamb at a top of the elongated section and wherein the lower flange is oriented out of plane relative to the elongated section at a second bend, is defined between the second free end of the monolithic bracket and the second bend, extends along a horizontal plane substantially perpendicular to the elongated section and in the direction away from the jamb at a bottom of the elongated section, the lower flange being spaced apart from the upper flange by the elongated section;

an upper hinge that couples a top end of a door to the upper flange of the bracket; and a lower hinge that couples a bottom end of the door to the lower flange of the bracket.

2. The door mount of claim 1, wherein the upper flange of the bracket comprises a through hole and the lower flange of the bracket comprises a through hole.

3. The door mount of claim 2, wherein the upper hinge comprises an upper hinge pin fixed to an upper hinge plate that is coupled to the top end of the door, the upper hinge pin extending from the upper hinge plate through the through hole in the planar upper flange of the bracket to a free end.

4. The door mount of claim 3, further comprising an upper door strap mounted between the top end of the door and the upper hinge plate, wherein the upper hinge pin is free to rotate within the through hole in the planar upper flange when the door is rotated.

5. The door mount of claim 4, further comprising a nut fastened to the free end of the upper hinge pin to limit the axial movement of the upper hinge pin.

6. The door mount of claim 2, wherein the lower hinge comprises a lower hinge plate that is coupled to the bottom end of the door and coupled to a gravity pivot assembly.

7. The door mount of claim 6, wherein the through hole in the planar lower flange comprises a star-shaped through hole.

8. The door mount of claim 7, wherein the gravity pivot assembly comprises a lower hinge pin fixed to the lower hinge plate, the lower hinge pin extending from the lower hinge plate to a beveled end that engages with a cam having a star-shaped drive that corresponds with the star shaped through hole in the lower flange, wherein the star-shaped drive engages with the star-shaped through hole in the planar lower flange so that the door is oriented relative to the wall at an acute angle when at rest.

9. A door mount comprising:

a monolithic elongated bar including a substantially vertical portion attached to a door jamb that is mounted to an end of a wall, a first free end and an opposing second free end, wherein the monolithic elongated bar includes a planar top projecting portion that is oriented out of plane relative to the substantially vertical portion at a first bend, is defined between the first free end and the first bend and extends substantially normal to the substantially vertical portion and wherein the monolithic elongated bar includes a planar bottom projecting portion that is oriented out of plane relative to the substantially vertical portion at a second bend, is defined between the second free end and the second bend and extends substantially normal to the substantially vertical portion;

a top hinge coupling a top end of a door to the planar top projecting portion; and a bottom hinge coupling a bottom end of the door to the planar bottom projecting portion; and wherein the door is oriented at an acute angle relative to the wall when at rest.

10. The door mount of claim 9, wherein the planar top projecting portion and the planar bottom projecting portion of the monolithic elongated bar extend in a direction away from the door jamb.

11. The door mount of claim 10, wherein the top hinge is fixed to the top end of the door and comprises a pin that is free to rotate within the through hole in the planar top projecting portion.

12. The door mount of claim 10, wherein the bottom hinge is fixed to the bottom end of the door by a lower hinge plate and comprises a gravity pivot assembly.

13. The door mount of claim 12, wherein the gravity pivot assembly comprises a pin fixed to the lower hinge plate and extending from the lower hinge plate to a beveled end that engages with a cam, the cam including a star-shaped drive that corresponds with and engages with the star-shaped through hole in the planar bottom projecting portion so that the door is oriented relative to the wall at the acute angle when at rest.

14. The door mount of claim 9, wherein the planar top projecting portion comprises a through hole and the planar bottom projecting portion comprises a through hole, the through hole in the planar bottom projecting portion is star-shaped.

15. A method of mounting a door to a wall, the method comprising:

mounting a monolithic hinge mount bar to an end of a wall, the hinge mount bar including a first free end, an opposing second free end, a planar upper flange, a planar lower flange and a planar elongated section, wherein the planar upper flange is oriented out of plane relative to the planar elongated section at a first bend, is defined between the first free end of the bar and the first bend and extends in a direction away from the end of the wall and wherein the planar lower flange is oriented out of plane relative to the planar elongated section at a second bend, is defined between the second free end of the bar and the second bend, extends in the direction away from the end of the wall and is spaced apart from the upper flange by the elongated section, the hinge mount bar providing repeated placement of the planar upper flange relative to the planar lower flange;

fastening an upper hinge that couples to a top end of a door to the planar upper flange of the hinge mount bar; and fastening a lower hinge that couples to a bottom end of the door to the planar lower flange of the hinge mount bar.

16. The method of claim 15, wherein mounting the hinge mount bar to an end of a wall comprises mounting the hinge mount bar to a door jamb that is attached to the end of the wall.

17. The method of claim 15, wherein the door jamb includes drilling dimples so that the hinge mount bar is mounted to the door jamb at a set location.

18. The method of claim 15, wherein fastening the upper hinge to the planar upper flange of the hinge mount bar comprises:

fastening an upper hinge plate to an upper door strap mounted to the top end of the door;

inserting an upper hinge pin that extends from the upper hinge plate through a through hole in the planar upper flange of the hinge mount bar to a free end; and installing a nut on the free end of the upper hinge pin.

19. The method of claim 15, wherein fastening the lower hinge to the planar lower flange of the hinge mount bar comprises:

fastening a lower hinge plate to a lower door strap mounted to the bottom end of the door; and inserting a gravity pivot assembly that is coupled to the lower hinge plate into the planar lower flange of the hinge mount bar.

* * * * *